US005601968A

United States Patent [19]

Weber et al.

[11] Patent Number: 5,601,968

[45] Date of Patent: Feb. 11, 1997

[54] COLOR PHOTOGRAPHIC SILVER HALIDE MATERIAL

[75] Inventors: Beate Weber, Leichlingen; Hans Langen, Bonn; Uwe Dahlhaus, Burscheid; Thomas Hübsch, Leverkusen, all of Germany

[73] Assignee: Agfa-Gevaert Aktiengesellschaft, Germany

[21] Appl. No.: 634,503

[22] Filed: Apr. 18, 1996

[30] Foreign Application Priority Data

Apr. 25, 1995 [DE] Germany ..... 195 15 143.7

[51] Int. Cl.[6] ..... G03C 7/396; G03C 7/38

[52] U.S. Cl. ..... 430/551; 430/554; 430/555

[58] Field of Search ..... 430/551, 555, 430/554

[56] References Cited

U.S. PATENT DOCUMENTS 4,463,085 7/1984 Mitsui et al. ..... 430/372
4,517,283 5/1985 Leppard et al. ..... 430/551

FOREIGN PATENT DOCUMENTS 0075526 4/1987 Japan ..... 430/557

*Primary Examiner*—Lee C. Wright
*Attorney, Agent, or Firm*—Connolly & Hutz

[57] ABSTRACT

A color photographic silver halide material with a support and at least one silver halide emulsion layer applied thereto which contains at least one 2-equivalent pyrazolone magenta coupler of the formula (I)

(I)

with the substituents having the meanings stated in the specification and at least one amine which contains repeat units of the formulae (II) or (III)

(II)

(III)

with the substituents having the meanings stated in the specification, is distinguished by reduced fogging and color spotting during storage.

9 Claims, No Drawings

COLOR PHOTOGRAPHIC SILVER HALIDE MATERIAL

This invention relates to a color photographic silver halide material with improved stability which contains at least one 2-equivalent pyrazolone magenta coupler in at least one silver halide emulsion layer.

It is known from DE 3 246 292 that certain piperidine compounds prevent the spotting caused on color development by 2-equivalent 4-arylthio-5-pyrazolone magenta couplers.

A disadvantage of these piperidines in that they bring about a reduction in maximum density on reaction of the developer oxidation product with the stated magenta couplers.

The object of the invention is thus to provide additives for 2-equivalent pyrazolone magenta couplers which protect the photographic material from fogging and color spotting during storage without resulting in a lower maximum density or flatter gradation.

Surprisingly, this object is achieved by polymeric amines of a certain structure.

The present invention thus provides a color photographic silver halide material with a support and at least one silver halide emulsion layer applied thereto which contains at least one 2-equivalent pyrazolone magenta coupler of the formula (I)

(I)

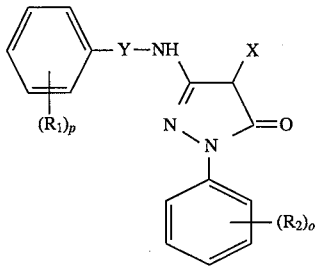

in which $R_1$ means hydrogen, alkyl, aryl, acyl, fluorine, chlorine, bromine, sulphonyl, silyl, nitro, alkoxycarbonyl, cyano, aroxycarbonyl, acylamino, sulphonamido or trifluoromethyl, $R_2$ means fluorine, chlorine, bromine, acyl, alkyl, alkoxy, alkoxycarbonyl, cyano, alkylsulphonyl, arylsulphonyl, alkoxysulphonyl, aroxysulphonyl, acylamino, sulphonamido, trifluoromethyl or nitro, X means an elimination group, Y means a direct bond or CO and o and p mean a number from 1 to 5, wherein, in the event that p is >1, there would be more than one $R_1$ substituent and the substituents $R_1$ may be identical or different to the other $R_1$'s, wherein the event that o is >1, there would be more than one $R_2$ substituent and the substituents $R_2$ may be identical or different to the other $R_2$'s, and at least one amine which contains repeat units of the formulae (II) or (III)

(II)

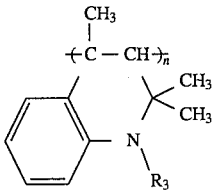

-continued (III)

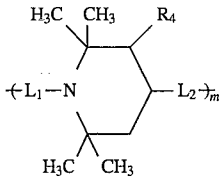

in which $R_3$ means hydrogen or alkyl $R_4$ means hydrogen or alkyl $L_1$ means a divalent group, preferably

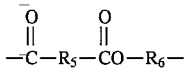

$L_2$ means —O— or —$NR_7$—, m,n mean an number greater than 2, in particular 3 to 15, $R_5$, $R_6$ mean alkylene, arylene or cycloalkylene, $R_7$ means hydrogen or alkyl, wherein $L_1$ is attached via $R_6$ to the nitrogen atom of the piperidine ring.

Particularly preferred magenta couplers are of the formula (IV)

(IV)

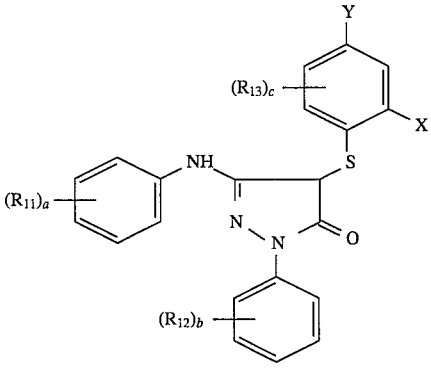

in which $R_{11}$ means hydrogen, alkyl, alkoxy, aryl, acyl, fluorine, chlorine, bromine, sulphonyl, silyl, nitro, alkoxycarbonyl, cyano, aroxycarbonyl, acylamino, sulphonamido, trifluoromethyl, $R_{12}$ means fluorine, chlorine, bromine, acyl, alkyl, alkoxy, alkoxycarbonyl, cyano, alkylsulphonyl, arylsulphonyl, alkoxysulphonyl, aroxysulphonyl, acylamino, sulphonamido, trifluoromethyl, nitro, $R_{13}$ means hydrogen, alkyl, aryl, acyl, fluorine, chlorine, bromine, sulphonyl, silyl, alkoxycarbonyl, cyano or aroxycarbonyl, X means hydrogen, acylamino, sulphonamido, alkyl, alkoxy, alkoxycarbonyl, cyano, alkylsulphonyl, arylsulphonyl, alkoxysulphonyl, aroxysulphonyl, Y means hydrogen, acylamino, sulphonamido, alkyl, alkoxy, alkoxycarbonyl, cyano, alkylsulphonyl, arylsulphonyl, alkoxysulphonyl, aroxysulphonyl, providing that either X or Y is hydrogen, a, b mean a number from 1 to 5 and c means a number from 0 to 4.

Preferred couplers of the formula (IV) are those in which Y means hydrogen and X means acylamino or sulphonamido, one of the residues $R_1$ is in ortho position relative to the NH group and means alkoxy, fluorine, chlorine or bromine and b means a number from 3 to 5.

Couplers of the formula (V) are very particularly preferred (V)

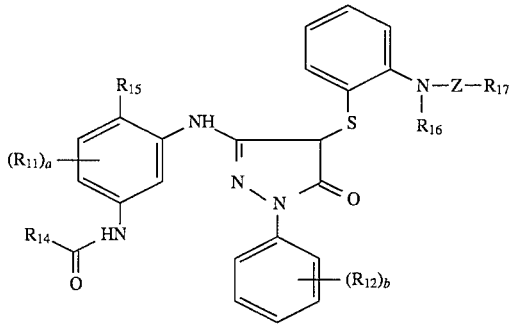

in which $R_{11}$ and $R_{12}$ have the above-stated meaning, $R_{14}$ means alkyl, aryl, acyl, alkoxycarbonyl or aryloxycarbonyl, $R_{15}$ means fluorine, chlorine, bromine or alkoxy, $R_{16}$ means hydrogen, alkyl or aryl, $R_{17}$ means alkyl or aryl, Z means —CO—, —SO— or —$SO_2$—, a means 0 or 1 and b means a number from 3 to 5.

Suitable couplers of the formulae (I), (IV) and (V) are:

I-1

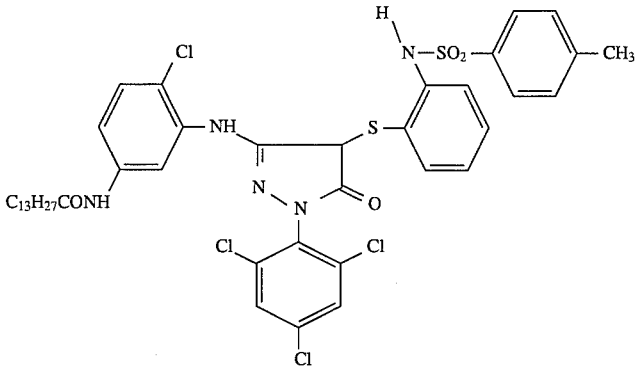

I-2

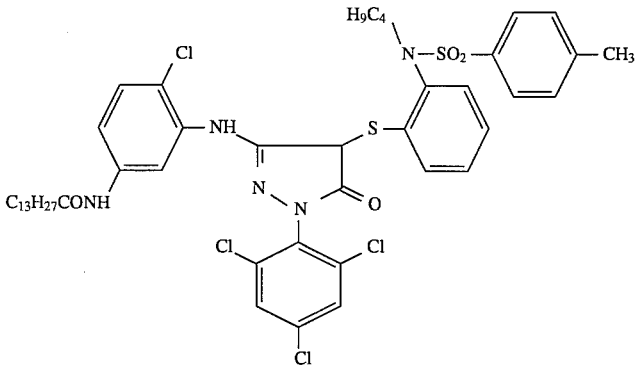

I-3

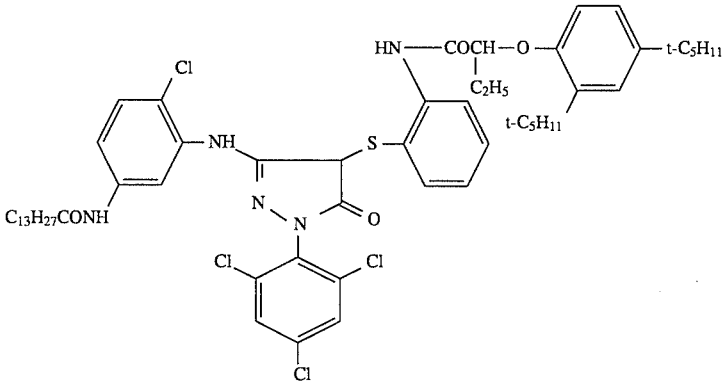

-continued
I-4
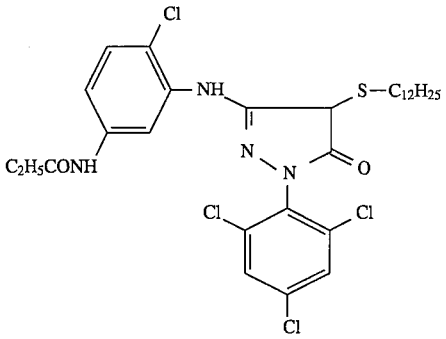
I-5
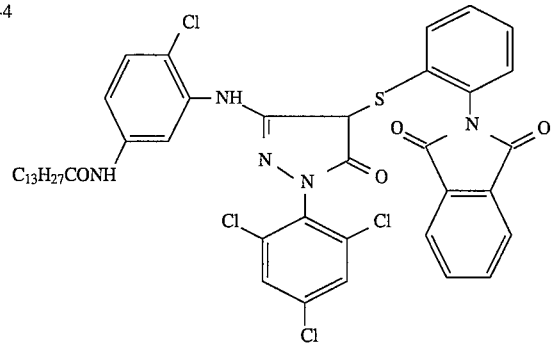
I-6
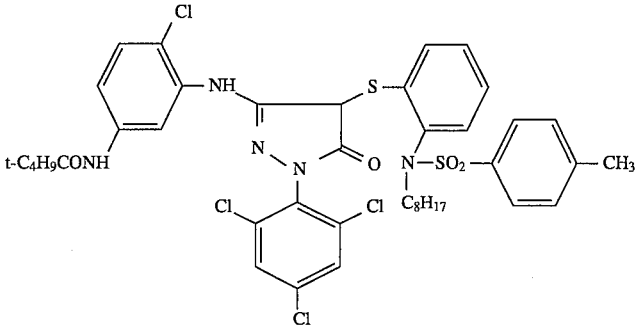
I-7
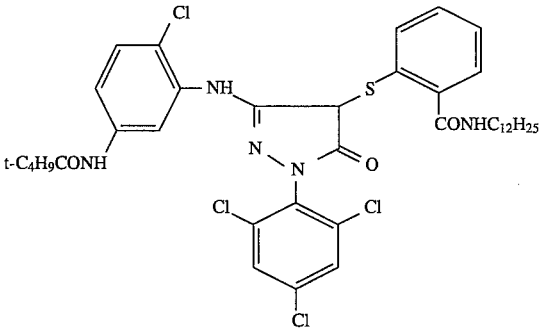
I-8
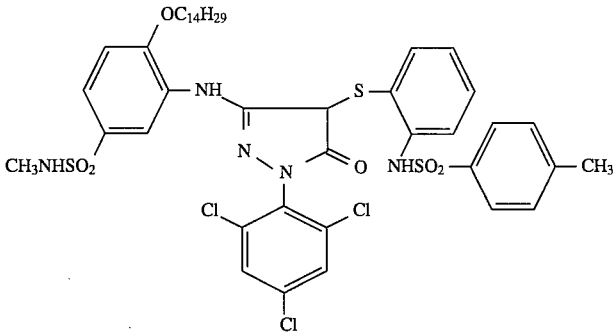

-continued
I-9
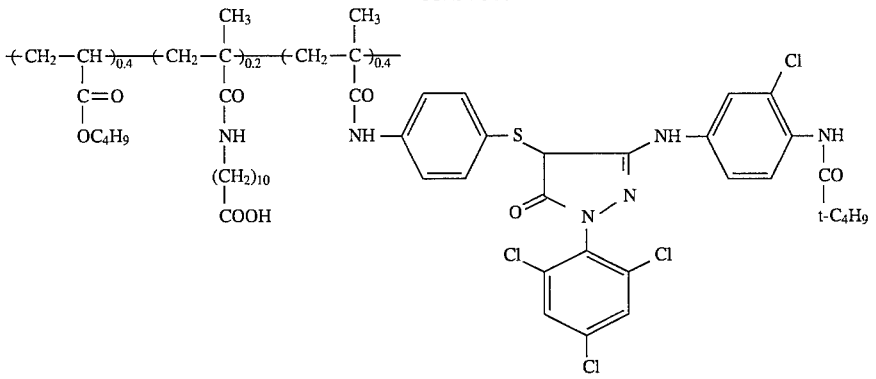
I-10
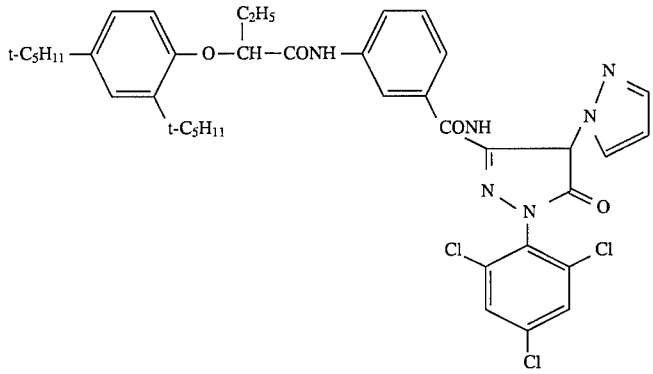
I-11
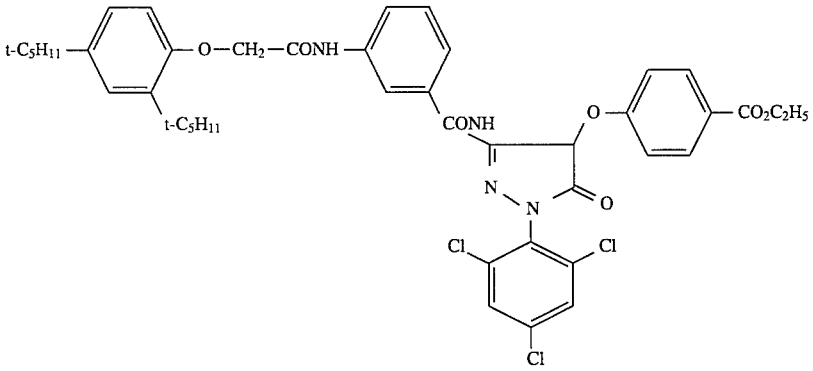
I-12
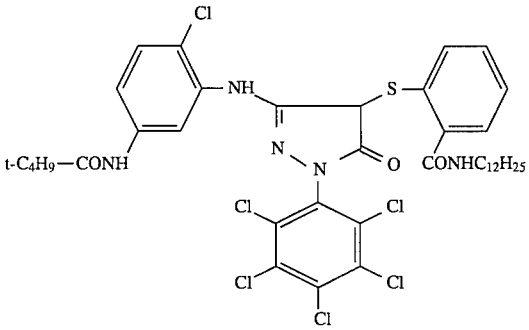
Examples to compounds of the formula (II) are:
II-1: $R_3$=H; $\bar{n}$=3,5
II-2: $R_3$=$CH_3$; $\bar{n}$=3,5
II-3: $R_3$=n—$C_4H_9$; $\bar{n}$=3,5
II-4: $R_3$=n—$C_{14}H_{29}$; $\bar{n}$=3,6
$\bar{n}$ is the average degree of polymerization.
Examples of compounds of the formula (III) are:

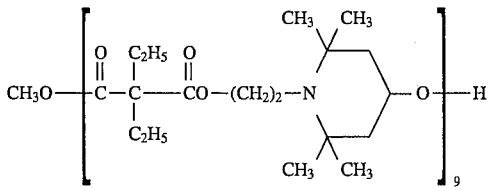

III-1

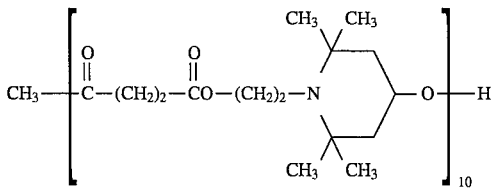

III-2

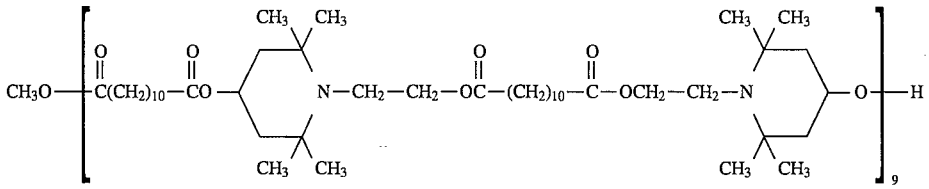

III-3

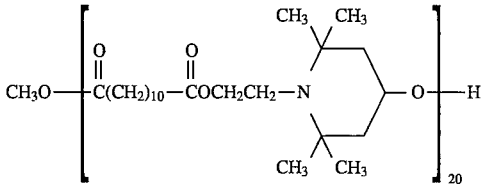

III-4

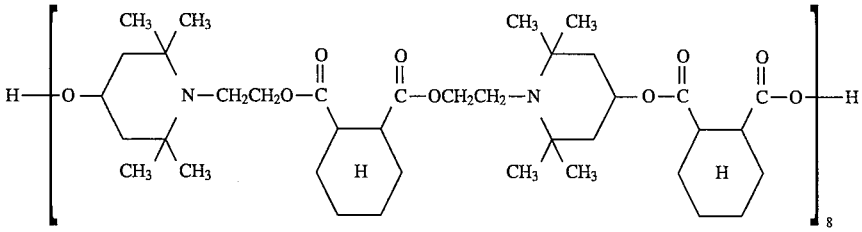

III-5

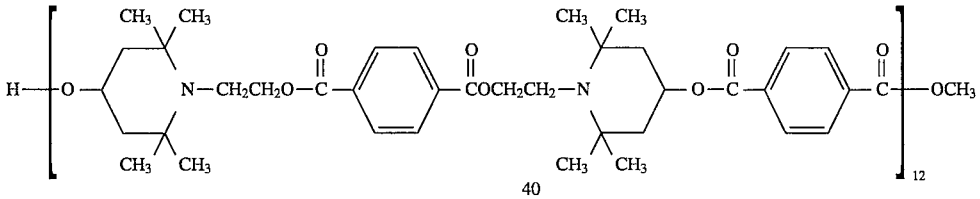

III-6

The compounds of the formula (II) and (Ill) are used in a total quantity of 10 to 200 mol. %, in particular of 20 to 60 mol. % per mol of magenta coupler and are emulsified either together with the magenta coupler or separately from the magenta coupler and in the second case are combined in emulsified form with the coupler emulsion.

The material according to the invention is in particular a color photographic silver halide material with a support, at least one red-sensitive silver halide emulsion layer containing at least one cyan coupler, at least one green-sensitive silver halide emulsion layer containing at least one magenta coupler, at least one blue-sensitive silver halide emulsion layer containing at least one yellow coupler, wherein all the green-sensitive and all the red-sensitive silver halide emulsion layers are arranged closer to the support than all the blue-sensitive silver halide emulsion layers. A yellow filter layer is conventionally located between the blue-sensitive silver halide emulsion layers on the one hand and the green-sensitive and red-sensitive silver halide emulsion layers on the other hand. This filter layer may contain as its active constituent colloidal silver or a yellow dye which it must be possible to decolor or rinse out. Such dyes are known from the literature.

The material preferably contains 2 or 3 blue-, green- and red-sensitive layers.

Suitable transparent supports for the production of color photographic materials are, for example, films and sheet of semi-synthetic and synthetic polymers, such as cellulose nitrate, cellulose acetate, cellulose butyrate, polystyrene, polyvinyl chloride, polyethylene terephthalate, polyethylene naphthalate and polycarbonate. These supports may also be colored black for light-shielding purposes. The surface of the support is generally subjected to a treatment in order to improve the adhesion of the photographic emulsion layer, for example corona discharge with subsequent application of a substrate layer. The reverse side of the support may be provided with a magnetic layer and an antistatic layer.

The essential constituents of the photographic emulsion layers are the binder, silver halide grains and color couplers.

Gelatine is preferably used as the binder. Gelatine may, however, be entirely or partially replaced with other synthetic, semi-synthetic or also naturally occurring polymers. Synthetic gelatine substitutes are, for example, polyvinyl alcohol, poly-N-vinylpyrrolidone, polyacryl-amides, polyacrylic acid and the derivatives thereof, in particular the copolymers thereof. Naturally occurring gelatine substitutes are, for example, other proteins such as albumin or casein, cellulose, sugar, starch or alginates. Semi-synthetic gelatine substitutes are usually modified natural products. Cellulose derivatives such as hydroxyalkylcellulose, carboxymethylcellulose and phthalyl-cellulose together with gelatine derivatives obtained by reaction with alkylating or acylating agents or by grafting polymerizable monomers, are examples of such products.

The binders should have a sufficient quantity of functional groups available so that satisfactorily resistant layers may be produced by reaction with suitable hardeners. Such functional groups are in particular amino groups, but also carboxyl groups, hydroxyl groups and active methylene groups.

The silver halide present as the photosensitive constituent in the photographic material may contain chloride, bromide or iodide or mixtures thereof as the halide. For example, the halide content of at least one layer may consist of 0 to 15 mol. % of iodide, 0 to 20 mol. % of chloride and 65 to 100 mol. % of bromide. The crystals may be predominantly compact, for example regularly cubic or octahedral, or they may have transitional shapes. Preferably, however, lamellar crystals may also be present, the average ratio of diameter to thickness of which is preferably at least 5:1, wherein the diameter of a grain is defined as the diameter of a circle the contents of which correspond to the projected surface area of the grain. The layers may, however, also have tabular silver halide crystals in which the ratio of diameter to thickness is substantially greater than 5:1, for example 12:1 to 30:1.

The silver halide grains may also have a multi-layered grain structure, in the simplest case with one internal zone and one external zone of the grain (core/shell), wherein the halide composition and/or other modifications, such as for example doping, of the individual grain zones are different. The average grain size of the emulsions is preferably between 0.2 μm and 2.0 μm, the grain size distribution may be both homodisperse and heterodisperse. A homodisperse grain size distribution means that 95% of the grains deviate by no more than ±30% from the average grain size. The emulsions may, in addition to the silver halide, also contain organic silver salts, for example silver benzotriazolate or silver behenate.

Two or more types of silver halide emulsions which are produced separately may be used as a mixture.

The silver halides are precipitated, deionized, chemically ripened, spectrally sensitized and stabilized in the conventional manner.

The differently sensitized emulsion layers are associated with non-diffusing monomeric or polymeric color couplers which may be located in the same layer or in an adjacent layer. Usually, cyan couplers are associated with the red-sensitive layers, magenta couplers with the green-sensitive layers and yellow couplers with the blue-sensitive layers.

Color couplers to produce the cyan partial color image are generally couplers of the phenol or α-naphthol type or pyrroloazoles (EP 456 226).

Color couplers to produce the magenta partial color image are, as already explained above, couplers of the 2-equivalent pyrazolone type. Up to 50 mol. % of magenta couplers of the 4-equivalent pyrazolone or of the pyrazolotriazole type may be added to these 2-equivalent pyrazolone couplers.

Color couplers to produce the yellow partial color image are generally couplers of the acylacetanilide and malonamide type.

The color couplers may be 4-equivalent couplers, but they may also be 2-equivalent couplers. The latter are differentiated from 4-equivalent couplers by containing a substituent at the coupling site which is eliminated on coupling. 2-equivalent couplers are considered to be those which are colorless, as well as those which have an intense intrinsic color which on color coupling disappears or is replaced by the color of the image dye produced (masking couplers), and white couplers which, on reaction with color developer oxidation products, give rise to substantially colorless products. 2-equivalent couplers are further considered to be those which contain an eliminate residue at the coupling site, which residue is liberated on reaction with color developer oxidation products and so either directly or after one or more further groups are eliminated from the initially eliminated residue (for example, DE-A-27 03 145, DE-A-28 55 697, DE-A-31 05 026, DE-A-33 19 428), produces a specific desired photographic effect, for example as a development inhibitor or accelerator. Examples of such 2-equivalent couplers are the known DIR couplers as well as DAR or FAR couplers.

DIR couplers which release azole type development inhibitors, for example triazoles and benzotriazoles, are described in DE-A-24 14 006, 26 10 546, 26 59 417, 27 54 281, 28 42 063, 36 26 219, 36 30 564, 36 36 824, 36 44 416. Further advantages for color reproduction, i.e. color separation and color purity, and for the reproduction of detail, i.e. sharpness and grain, are to be achieved with such DIR couplers, which, for example, do not release the development inhibitor immediately as a consequence of coupling with an oxidized color developer, but instead only after a further subsequent reaction, which is, for example, achieved with a time control group. Examples of this are described in DE-A-28 55 697, 32 99 671, 38 18 231, 35 18 797, in EP-A-0 157 146 and 0 204 175, in U.S. Application Nos. 4,146,396 and 4,438,393 and in GB-A-2 072 363.

DIR couplers which release a development inhibitor which is decomposed in the developer bath to substantially photographically inactive products are, for example, described in DE-A-32 09 486 and EP-A-0 167 168 and 0 219 713. By this means, unproblematic development and processing consistency are achieved.

When DIR couplers are used, particularly those which eliminate a readily diffusible development inhibitor, improvements in color reproduction, for example more differentiated color reproduction, may be achieved by suitable measures during optical sensitization, as are described, for example, in EP-A-0 115 304, 0 167 173, GB-A-2 165 058, DE-A-37 00 419 and U.S. Application No. 4,707,436.

The DIR couplers may, in a multi-layer photographic material, be added to the most various layers, for example also to non-photosensitive layers or interlayers. Preferably, however, they are added to the photosensitive silver halide emulsion layers, wherein the characteristic properties of the silver halide emulsion, for example its iodide content, the structure of the silver halide grains or the grain size distribution thereof influence the photographic properties achieved. The influence of the released inhibitors may, for example, be restricted by the incorporation of an inhibitor scavenging layer according to DE-A-24 31 223. For reasons of reactivity or stability, it may be advantageous to use a DIR coupler which on coupling forms a color in the layer in which it is accommodated, which is different from the color to be produced in this layer.

In order to increase sensitivity, contrast and maximum density, principally DAR or FAR couplers may be used which eliminate a development accelerator or fogging agent. Compounds of this type are described, for example, in DE-A-25 34 466, 32 09 110, 33 33 355, 34 10 616, 34 29 545, 34 41 823, in EP-A-0 089 834, 0 110 511, 0 118 087, 0 147 765 and in U.S. Application Nos. 4,618,572 and 4,656,123.

Reference is made to EP-A-193 389 as an example of the use of BAR couplers (bleach accelerator releasing couplers).

It may be advantageous to modify the effect of a photographically active group eliminated from a coupler by causing an intermolecular reaction of this group after its release with another group according to DE-A-35 06 805.

Since with the DIR, DAR or FAR couplers it is mainly the activity of the residue released on coupling that is desired and the chromogenic properties of these couplers are of lesser importance, those DIR, DAR or FAR couplers which give rise to substantially colorless products on coupling are also suitable (DE-A-15 47 640).

The eliminable residue may also be a ballast residue such that, on reaction with color developer oxidation products, coupling products are obtained which are diffusible or have at least weak or restricted mobility (U.S. Application No. 4,420,556).

The material may, in addition to couplers, contain various compounds which, for example, may liberate a development inhibitor, a development accelerator, a bleach accelerator, a developer, a silver halide solvent, a fogging agent or an anti-fogging agent, for example so-called DIR hydroquinones and other compounds as, for example, described in U.S. Application Nos. 4,636,546, 4,345,024, 4,684,604 and in DE-A-31 45 640, 25 15 213, 24 47 079 and in EP-A-198 438. These compounds fulfill the same function as the DIR, DAR or FAR couplers, except that they produce no coupling products.

High-molecular weight color couplers are, for example, described in DE-C-1 297 417, DE-A-24 07 569, DE-A-31 48 125, DE-A-32 17 200, DE-A- 33 20 079, DE-A-33 24 932, DE-A-33 31 743, DE-A-33 40 376, EP-A-27 284, U.S. Application No. 4,080,211. The high-molecular weight color couplers are generally produced by polymerization of ethylenically unsaturated monomeric color couplers. They may, however, also be obtained by polyaddition or polycondensation.

The incorporation of couplers or other compounds into the silver halide emulsion layers may proceed by initially producing a solution, dispersion or emulsion of the compound concerned and then adding it to the pouring solution for the layer concerned. Selection of the appropriate solvent or dispersant depends on the particular solubility of the compound.

Methods for the introduction of compounds which are substantially insoluble in water by a grinding process are described, for example, in DE-A-26 09 741 and DE-A-26 09 742.

Hydrophobic compounds may also be introduced into the pouring solution by using high-boiling solvents, so-called oil formers. Corresponding methods are described, for example, in U.S. Application No. 2,322,027, U.S. Application No. 2,801,170, U.S. Application No. 2,801,171 and EP-A-0 043 037.

Oligomers or polymers, so-called polymeric oil formers, may be used instead of high-boiling solvents.

The compounds may also be introduced into the pouring solution in the form of filled latices. Reference is, for example, made to DE-A-25 41 230, DE-A-25 41 274, DE-A-28 35 856, EP-A-0 014 921, EP-A-0 069 671, EP-A-0 130 115, U.S. Application No. 4,291,113.

The non-diffusible inclusion of anionic water-soluble compounds (for example of dyes) may also proceed with the assistance of cationic polymers, so-called mordanting polymers.

Suitable oil formers are, for example, phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

Examples of suitable oil formers are dibutyl phthalate, dicyclohexyl phthalate, di-2-ethylhexyl phthalate, decyl phthalate, triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphate, 2-ethylhexyl benzoate, dodecyl benzoate, 2-ethylhexyl p-hydroxybenzoate, diethyldodecanamide, N-tetradecylpyrrolidone, isostearyl alcohol, 2,4-di-t-amylphenol, dioctyl acetate, glycerol tributyrate, iso-stearyl lactate, trioctyl citrate, N,N-dibutyl-2-butoxy-5-t-octyl aniline, paraffin, dodecylbenzene and diisopropylnaphthalene.

The non-photosensitive interlayers generally arranged between layers of different spectral sensitivity may contain agents which prevent an undesirable diffusion of developer oxidation products from one photosensitive layer into another photosensitive layer with a different spectral sensitization.

Suitable agents, which are also known as scavengers or DOP scavengers, are described in *Research Disclosure* 17 643 (December 1978), section VII, 17 842 (February 1979) and 18 716 (November 1979), page 650 and in EP-A-0 069 070, 0 098 072, 0 124 877, 0 125 522.

If there are two or more partial layers of the same spectral sensitization, then they may differ in composition, particularly in terms of the type and quantity of silver halide grains. In general, the partial layer with the greater sensitivity will be located further from the support than the partial layer with lower sensitivity. Partial layers of the same spectral sensitization may be adjacent to each other or may be separated by other layers, for example by layers of different spectral sensitization. Thus, for example, all high sensitivity and all low sensitivity layers may be grouped together each in a package of layers (DE-A-19 58 709, DE-A-25 30 645, DE-A-26 22 922).

The photographic material may also contain UV light absorbing compounds, optical whiteners, spacers, filter dyes, formalin scavengers, light stabilizers, anti-oxidants, $D_{min}$ dyes, additives to improve stabilization of dyes, couplers and whites and to reduce color fogging, plasticisers (latices), biocides and others.

Ultra-violet absorbing couplers (such as cyan couplers of the α-naphthol type) and ultra-violet absorbing polymers may also be used. These ultra-violet absorbents may be fixed into a specific layer by mordanting.

Filter dyes suitable for visible light include oxonol dyes, hemioxonol dyes, styryl dyes, merocyanine dyes, cyanine dyes and azo dyes. Of these dyes, oxonol dyes, hemioxonol dyes and merocyanine dyes are particularly advantageously used.

Suitable optical whiteners are, for example, described in *Research Disclosure* 17 643 (December 1978), section V, in U.S. Application Nos. 2,632,701, 3,269,840 and in GB-A-852 075 and 1 319 763.

Certain binder layers, in particular the layer furthest away from the support, but also occasionally interlayers, particularly if they constitute the layer furthest away from the support during manufacture, may contain photographically inert particles of an inorganic or organic nature, for example as flatting agents or spacers (DE-A-33 31 542, DE-A-34 24 893, *Research Disclosure* 17 643 (December 1978), section XVI).

The average particle diameter of the spacers is in particular in the range from 0.2 to 10 μm. The spacers are insoluble in water and may be soluble or insoluble in alkali, wherein alkali-soluble spacers are generally removed from the photographic material in the alkaline developing bath. Examples of suitable polymers are polymethyl methacrylate, copolymers of acrylic acid and methyl methacrylate together with hydroxypropylmethyl-cellulose hexahydrophthalate.

Additives to improve the stability of dyes, couplers and whites and to reduce color fogging (*Research Disclosure* 17 643 (December 1978), section VII) may belong to the following classes of chemical substances: hydroquinones, 6-hydroxychromans, 5-hydroxycoumarans, spirochromans, spiroindans, p-alkoxyphenols, sterically hindered phenols, gallic acid derivatives, methylene dioxybenzenes, aminophenols, sterically hindered amines, derivatives with esterified or etherified phenolic hydroxyl groups, metal complexes.

Compounds having both a sterically hindered amine partial structure and a sterically hindered phenol partial structure in a single molecule (U.S. Application No. 4,268,593) are particularly effective in preventing the impairment of yellow color images as a consequence of the action of heat, moisture and light. Spiroindans (JP-A-159 644/81) and chromans which are substituted by hydroquinone diethers or monoethers (JP-A-89 835/80) are particularly effective in preventing the impairment of crimson color images, in particular their impairment as a consequence of the action of light.

The layers of the photographic material according to the invention may be hardened with conventional hardeners. Suitable hardeners are, for example, formaldehyde, glutaraldehyde and similar aldehyde compounds, diacetyl, cyclopentadione and similar ketone compounds, bis-(2-chloroethylurea), 2-hydroxy-4,6-dichloro-1,3,5-triazine and other compounds containing reactive halogen (U.S. Application No. 3,288,775, U.S. Application No. 2,732,303, GB-A-974 723 and GB-A-1 167 207), divinylsulphone compounds, 5-acetyl-1,3-diacryloylhexahydro-1,3,5-triazine and other compounds containing a reactive olefin bond (U.S. Application No. 3,635,718, U.S. Application No. 3,232,763 and GB-A-994 869); N-hydroxymethyl-phthalimide and other N-methylol compounds (U.S. Application No. 2,732,316 and U.S. Application No. 2,586,168); isocyanates (U.S. Application No. 3,103,437); aziridine compounds (U.S. Application No. 3,017,280 and U.S. Application No. 2,983, 611); acid derivatives (U.S. Application No. 2,725,294 and U.S. Application No. 2,725,295); compounds of the carbodiimide type (U.S. Application No. 3,100,704); carbamoylpyridinium salts (DE-A-22 25 230 and DE-A-24 39 551); carbamoyloxypyridinium compounds (DE-A-24 08 814); compounds with a phosphorus-halogen bond (JP-A-113 929/83); N-carbonyloximide compounds (JP-A-43353/81); N-sulphonyloximido compounds (U.S. Application No. 4,111,926), dihydroquinoline compounds (U.S. Application No. 4,013,468), 2-sulphonyloxypyridinium salts (JP-A-110 762/81), formamidinium salts (EP-A-0 162 308), compounds with two or more N-acyloximino groups (U.S. Application No. 4,052,373), epoxy compounds (U.S. Application No. 3,091,537), compounds of the isoxazole type (U.S. Application No. 3,321,313 and U.S. Application No. 3,543,292); halogen carboxyldehydes, such as mucochloric acid; dioxane derivatives, such as dihydroxydioxane and dichlorodioxane; and inorganic hardeners such as chrome alum and zirconium sulphate.

Hardening may be effected in a known manner by adding the hardener to the pouring solution for the layer to hardened, or by overcoating the layer to be hardened with a layer containing a diffusible hardener.

There are included in the classes listed slow acting and fast acting hardeners as well as so-called instant hardeners, which are particularly advantageous. Instant hardeners are taken to be compounds which harden suitable binders in such a way that immediately after pouring, at the latest after 24 hours, preferably at the latest after 8 hours, hardening is concluded to such an extent that there is no further alteration in the sensitometry and swelling of the layered structure determined by the crosslinking reaction. Swelling is taken to be the difference between the wet layer thickness and the dry layer thickness during aqueous processing of the film (*Photogr. Sci. Eng.* 8 (1964), 275; *Photogr. Sci. Eng.* (1972), 449).

These hardeners which react very rapidly with gelatine are, for example, carbamoylpyridinium salts, which are capable of reacting with the free carboxyl groups of the gelatine, so that the latter react with free amino groups of the gelatine to form peptide bonds crosslinking the gelatine.

Color photographic negative materials are conventionally processed by developing, bleaching, fixing and rinsing or by developing, bleaching, fixing and stabilizing without subsequent rinsing, wherein bleaching and fixing may be combined into a single processing stage. Color developer compounds which may be used are all developer compounds having the ability to react, in the form of their oxidation product, with color couplers to form azomethine or indophenol dyes. Suitable color developer compounds are aromatic compounds containing at least one primary amino group of the p-phenylenediamine type, for example N,N-dialkyl-p-pheneylenediamines such as N,N-diethyl-p-phenylenediamine, 1-(N-ethyl-N-methanesulphonamido-ethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine. Further usable color developers are, for example, described in *J. Amer. Chem. Soc.* 73, 3106 (1951) and G. Haist *Modern Photographic Processing,* 1979, John Wiley & Sons, New York, pages 545 et seq.

An acid stop bath or rinsing may follow after color development.

Conventionally, the material is bleached and fixed immediately after color development. Bleaches which may be used are, for example, Fe(III) salts and Fe(III) complex salts such as ferricyanides, dichromates, water soluble cobalt complexes. Iron(III) complexes of amino-polycarboxylic acids are particularly preferred, in particular for example complexes of ethylenediamine-tetraacetic acid, propylenediaminetetraacetic acid, diethylenetriaminepentaacetic acid, nitrilotriacetic acid, iminodiacetic acid, N-hydroxyethylethylenediaminetriacetic acid, alkylimino-dicarboxylic acids and of corresponding phosphonic acids. Persulphates and peroxides, for example hydrogen peroxide, are also suitable as bleaches.

Rinsing usually follows the bleach/fixing bath or fixing bath, which is performed as countercurrent rinsing or comprises several tanks with their own water supply.

Favorable results may be obtained by using a subsequent finishing bath which contains no or only a little formaldehyde.

Rinsing may, however, be completely replaced with a stabilizing bath, which is conventionally operated countercurrently. If formaldehyde is added, this stabilizing bath also assumes the function of a finishing bath.

EXAMPLE 1 (comparison)

A color photographic recording material for color negative development (layer structure 1A) was produced by applying the following layers in the stated sequence onto a transparent cellulose triacetate film base. The stated quantities relate in each case to 1 $m^2$. The corresponding quantities of $AgNO_3$ are stated for the quantity of silver halide applied; the silver halides are stabilized with 0.5 g of 4-hydroxy-6-methyl-1,3,3a,7-tetraazaindene per mol of $AgNO_3$.

Layer 1 (Anti-halation layer)
0.06 g of dye FA1
0.06 g of dye FA2
0.12 g of black colloidal silver
0.2 g of UV absorber UV-2
0.8 g of gelatine Layer 2 (low-sensitivity red-sensitive layer)
0.8 g $AgNO_3$ of a red-sensitized AgBrClI emulsion with 10.5 mol. % of chloride and 2.4 mol. % of iodide, average grain diameter 0.35 μm
0.6 g of gelatine
0.21 g of colorless coupler C1
0.01 g of DIR coupler D1
0.02 g of colored coupler RC-1
0.01 g of colored coupler YC-1
0.25 g of tricresyl phosphate (TCP)

Layer 3 (medium-sensitivity red-sensitive layer)
1.6 g $AgNO_3$ of a red-sensitized AgBrClI emulsion with 10.4 mol. % of chloride, 9.4 mol. % of iodide, average grain diameter 0.5 μm,
0.8 g $AgNO_3$ of a red-sensitized AgBrI emulsion with 6.7 mol. % of iodide, average grain diameter 0.8 μm
0.22 g of colorless coupler C1
0.07 g of colored coupler RC-1
0.03 g of colored coupler YC-1
0.04 g of DIR coupler D-1
0.9 g of gelatine
0.32 g of TCP Layer 4 (high-sensitivity red-sensitive layer)
1.6 g $AgNO_3$ of red-sensitized AgBrClI emulsion with 6.8 mol. % of iodide, average grain diameter 1.1 μm,
1.2 g of gelatine
0.15 g of colorless coupler C2
0.05 g of DIR coupler D2
0.20 g of TCP Layer 5 (interlayer)
1.0 g of gelatine
0.1 g of dye FA3

Layer 6 (low-sensitivity green-sensitive layer)
0.54 g $AgNO_3$ of a green-sensitized AgBrClI emulsion with 10.4 mol. % of chloride, 9.5 mol. % of iodide, average grain diameter 0.5 μm
0.9 g of gelatine
0.43 g of colorless coupler I-1
0.005 g of DIR coupler D-1
0.001 g of DIR coupler D-3
0.02 g of colored coupler YM-1
0.05 g of scavenger SC-1
0.46 g of TCP Layer 7 (medium-sensitivity green-sensitive layer)
1.1 g $AgNO_3$ of a green-sensitive AgBrClI emulsion with 10.4 mol. % of chloride, 9.5 mol. % of iodide, average grain diameter 0.5 μm
0.34 g $AgNO_3$ of a green-sensitive AgBrI emulsion with 6.7 mol. % of iodide, average grain diameter 0.7 μm
0.24 g of colorless coupler I-1
0.04 g of colored coupler YM-1
0.005 g of DIR coupler D1
0.003 g of DIR coupler D3
0.9 g of gelatine
0.30 g of TCP Layer 8 (high-sensitivity green-sensitive layer)
1.7 g $AgNO_3$ of a green-sensitized AgBrI emulsion with 6.8 mol. % of iodide, average grain diameter 1.1 μm
1.2 g of gelatine
0.2 g of colorless coupler I-4
0.05 g of colored coupler YM-2
0.05 g of DIR coupler D2
0.3g of TCP Layer 9 (interlayer)
0.4 g of gelatine
0.02 g of polyvinylpyrrolidone Layer 10 (yellow filter layer)
0.1 g of yellow colloidal silver
0.2 g of gelatine
0.06 g of scavenger SC1
0.2 g of polyvinylpyrrolidone
0.1 g of TCP Layer 11 (low-sensitivity blue-sensitive layer)
0.18 g $AgNO_3$ of a blue-sensitized AgBrCII emulsion with 15 mol. % of chloride, 9 mol. % of iodide, average grain diameter 0.78 μm
0.2 g $AgNO_3$ of a blue-sensitized AgBrCII emulsion with 10.4 mol. % of chloride, 9.5 mol. % of iodide, average grain diameter 0.5 μm
0.89 g $AgNO_3$ of a blue-sensitized AgBrClI emulsion with 10 mol. % of iodide, average grain diameter 1.15 μm
1.0 g of gelatine
1.1 g of colorless coupler Y-1
0.03 g of DIR coupler D-1
1.1 g of TCP Layer 12 (medium-sensitivity blue-sensitive layer)
0.12 g $AgNO_3$ of a blue-sensitive AgBrClI emulsion with 15 mol. % of chloride, 8.8 mol. % of iodide, average grain diameter 0.77 μm
0.28 g $AgNO_3$ of a blue-sensitive AgBrClI emulsion with 15 mol. % of chloride, 12 mol. % of iodide, average grain diameter 1.0 μm
0.77 g of gelatine
0.58 g of colorless coupler Y-1
0.58 g of TCP Layer 13 (high-sensitivity blue-sensitive layer)
1.6 g $AgNO_3$ of a blue-sensitized AgBrI emulsion with 12 mol. % of iodide, average grain diameter 1.2 μm
0.9 g of gelatine
0.1 g of colorless coupler Y-1
0.02 g of DIR coupler D-2
0.2 g of TCP Layer 14 (micrate layer)
0.3 g $AgNO_3$ of an AgBrI emulsion with 4 mol. % of iodide, average grain diameter 0.05 μm
1.4 g of gelatine
0.1 g of UV absorber UV-1
0.3 g of UV absorber UV-2
0.5 g of TCP Layer 15 (protective and hardening layer)
0.2 g of gelatine
0.86 g of hardener of the formula

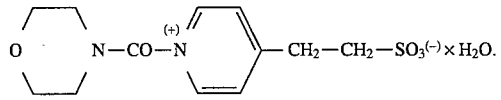

Substances used in example 1:

UV-1
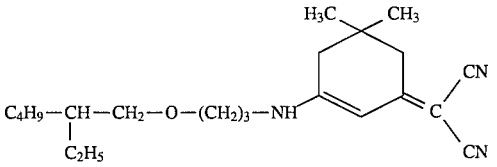
UV-2
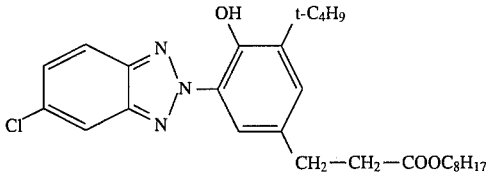
C-1
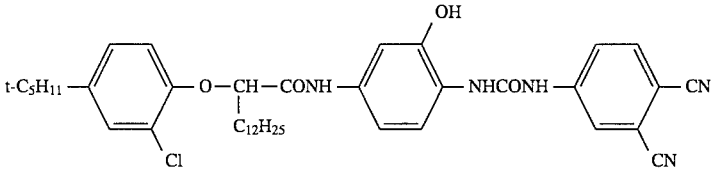
C-2
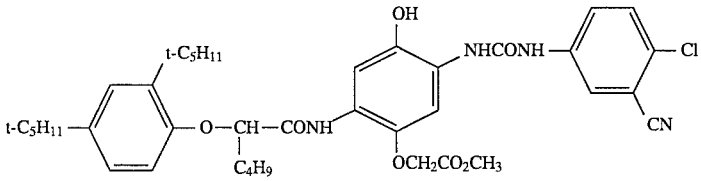
RC-1
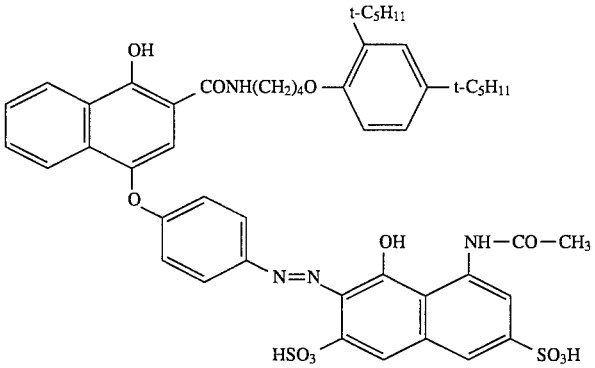
YM-1
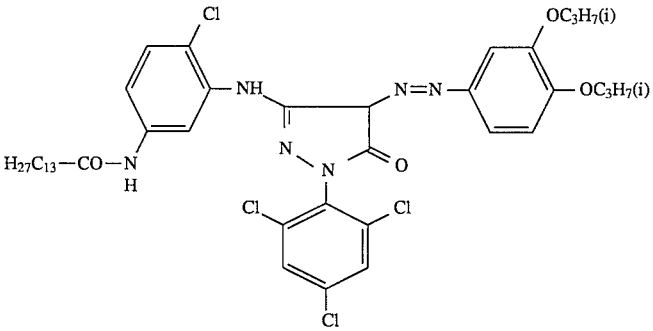
YM-2
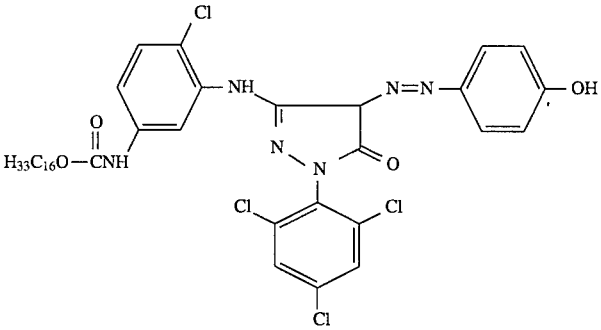

-continued
Y-1
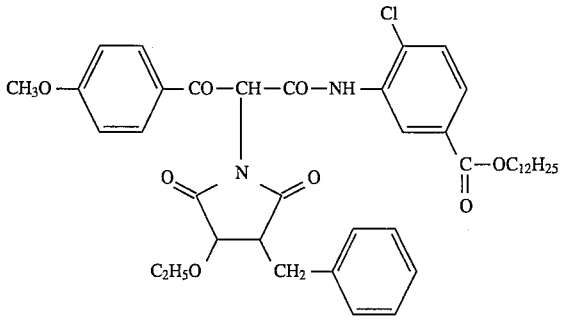
D-1
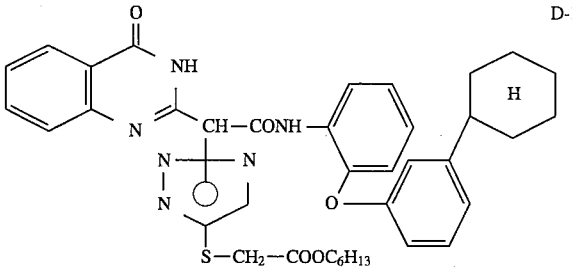
D-2
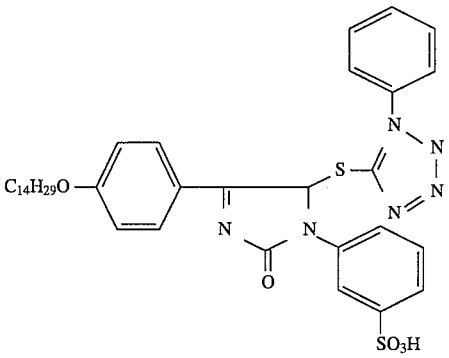
D-3
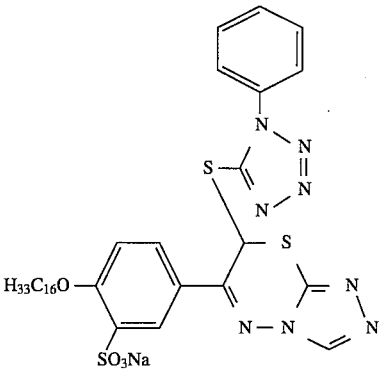
YC-1
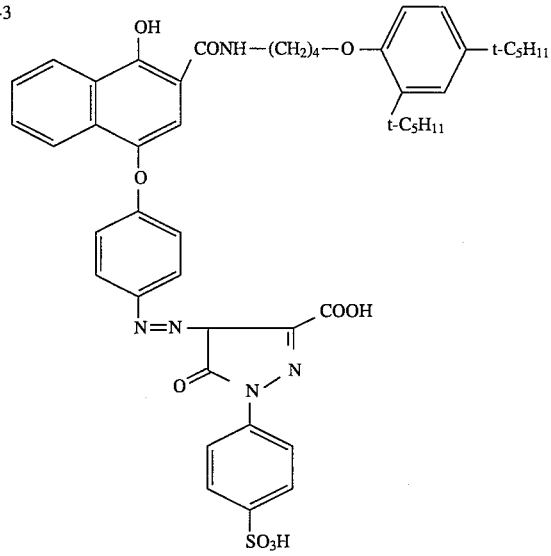
SC-1
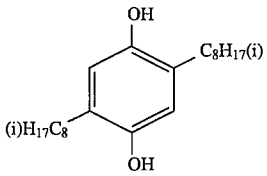
FA-1
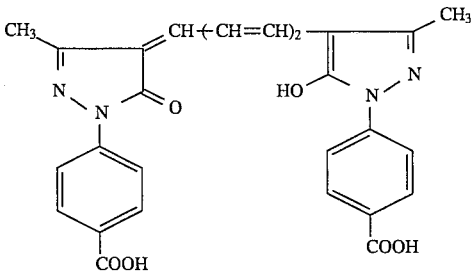

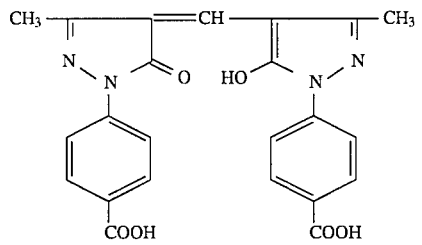

-continued

FA-2

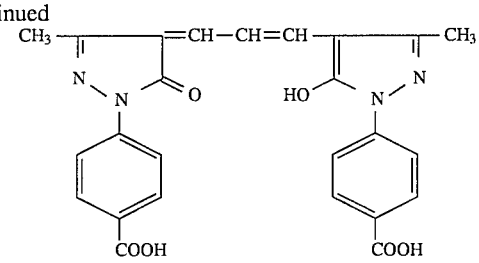

FA-3

Examples 2 to 8 differ from 1 in that 30 wt. % of compounds according to the invention, relative to the quantity of coupler in the layer concerned, are additionally emulsified into layers 6, 7 and 8. Example 9 contains a comparison compound from DE 3 246 292.

Two strips of each of examples 1 to 9 were exposed with white light behind a grey step wedge and processed using the color negative process described in *The British Journal of Photography* 1974, pages 597 and 598. While one of the two samples was subsequently stored at conventional room temperature, the other was stored for 3 days at 60° C./90% relative humidity. The magenta fog of the non-conditioned sample was then measured and density Dx on the gradation curve as found at the point: (sensitivity point at D=0.2+log H) was determined. The density and fog values for the conditioned samples were then measured at the same point and the differences vis-à-vis the non-conditioned samples were determined. The corresponding measured values may be found in table 1.

TABLE 1

| Example | Additive | $S_{fr}$ | $S_{gel}$ | $\Delta(Sgel - S_{fr})$ | $Dx_{fr.}$ | $Dx_{gel.}$ | $\Delta(D_{gel-fr.})$ |
|---|---|---|---|---|---|---|---|
| 1 | None | 0,59 | 0,92 | 0,33 | 1,46 | 2,36 | 0,90 |
| 2 | II-1 | 0,61 | 0,76 | 0,15 | 1,41 | 1,63 | 0,22 |
| 3 | II-2 | 0,60 | 0,74 | 0,14 | 1,45 | 1,69 | 0,24 |
| 4 | II-4 | 0,58 | 0,70 | 0,12 | 1,45 | 1,68 | 0,23 |
| 5 | III-2 | 0,59 | 0,70 | 0,11 | 1,50 | 1,71 | 0,21 |
| 6 | III-3 | 0,59 | 0,71 | 0,12 | 1,48 | 1,70 | 0,22 |
| 7 | III-5 | 0,57 | 0,69 | 0,12 | 1,46 | 1,68 | 0,22 |
| 8 | III-6 | 0,58 | 0,70 | 0,12 | 1,45 | 1,68 | 0,23 |
| 9 | V-1 | 0,68 | 0,79 | 0,11 | 1,24 | 1,48 | 0,24 |

V1 = comparison compound from DE 3 246 292
$S_{fr}$ = fog, fresh; $S_{gel}$ = fog, stored The compounds according to the invention distinctly reduce the increase in fog and density of the developed material when stored under tropical conditions (table 1).

While the use of comparison compound V1 does indeed also result in a smaller difference in fog, is also results in a distinct loss of density in the fresh state.

EXAMPLES 10 to 21

Examples 10 to 21 differ from example 1 in that other color couplers are used in layers 6, 7 and 8. The corresponding combinations and the results obtained after identical processing and identical storage (as described in example 1) may be found in table 2.

TABLE 2

| | Colour coupler in | | | | | | | |
|---|---|---|---|---|---|---|---|---|
| Test | layer 6 | layer 7 | layer 8 | Additive | $Dx_{fr.}$ | $Dx_{gel.}$ | $\Delta(D_{gel.}-D_{fr.})$ | |
| 10 | 0,43 g I-12 | 0,24 g I-12 | 0,2 g I-10 | — | 1,38 | 2,25 | 0,87 | Comparison |
| 11 | " | " | " | V1 | 1,20 | 1,46 | 0,26 | " |
| 12 | " | " | " | V2 | 1,18 | 1,52 | 0,34 | " |
| 13 | " | " | " | II-2 | 1,46 | 1,62 | 0,16 | According to the invention |
| 14 | 0,35 g I-5 | 0,20 g I-5 | 0,3 g I-5 | — | 1,48 | 2,34 | 0,86 | Comparison |
| 15 | " | " | " | V1 | 1,24 | 1,48 | 0,24 | " |
| 16 | " | " | " | V2 | 1,16 | 1,36 | 0,20 | " |

TABLE 2-continued

| Test | Colour coupler in layer 6 | layer 7 | layer 8 | Additive | $Dx_{fr.}$ | $Dx_{gel.}$ | $\Delta(D_{gel.}, D_{fr.})$ | |
|---|---|---|---|---|---|---|---|---|
| 17 | " | " | " | III-2 | 1,48 | 1,65 | 0,17 | According to the invention |
| 18 | 0,3 g I-11 | 0,17 I-11 | 0,25 g I-11 | — | 1,52 | 2,48 | 0,96 | Comparison |
| 19 | " | " | " | V1 | 1,28 | 1,45 | 0,17 | " |
| 20 | " | " | " | V2 | 1,36 | 1,56 | 0,20 | " |
| 21 | " | " | " | III-6 | 1,60 | 1,76 | 0,16 | According to the invention |

V-1

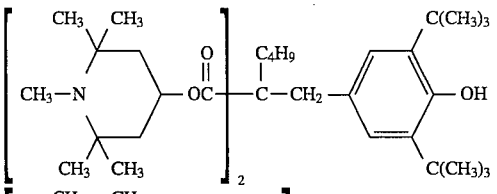

V-2

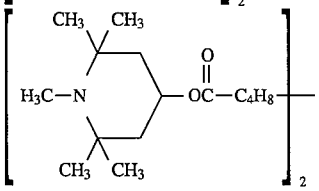

As may clearly be seen from table 2, the combinations according to the invention have distinct advantages at the achieved density in comparison with the comparison compounds and, after 3 days storage at 90% relative humidity, exhibit a distinctly lower increase in color density and consequently, due to their increased stability, exhibit a more constant sensitometry than the samples without an additive.

We claim:

1. A color photographic silver halide material comprising a support and least one silver halide emulsion layer applied thereto wherein said at least one silver halide emulsion layer contains at least one 2-equivalent pyrazolone magenta coupler of the formula (I)

(I)

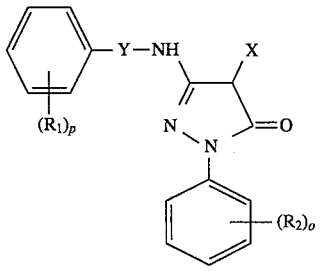

in which each $R_1$ is identical or different and means hydrogen, alkyl, aryl, acyl, fluorine, chlorine, bromine, sulphonyl, silyl, nitro, alkoxycarbonyl, cyano, aroxycarbonyl, acylamino, sulphonamido or trifluoromethyl, each $R_2$ is identical or different and means fluorine, chlorine, bromine, acyl, alkyl, alkoxy, alkoxycarbonyl, cyano, alkylsulphonyl, arylsulphonyl, alkoxysulphonyl, aroxysulphonyl, acylamino, sulphonamido, trifluoromethyl or nitro, X means an elimination group, Y means a direct bond or CO and o and p are identical or different and mean a number from 1 to 5, and at least one amine which contains repeat units of the formulae (II) or (III)

(II)

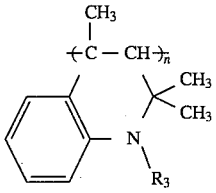

(III)

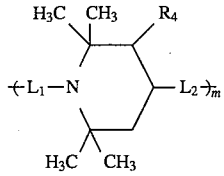

in which $R_3$ means hydrogen or alkyl $R_4$ means hydrogen or alkyl $L_1$ means a divalent group, $L_2$ means —O— or —$NR_7$—, m is a number greater than 2, n is a number at greater than 2;

$R_7$ means hydrogen or alkyl.

2. The Color photographic silver halide material according to claim 1, wherein the magenta coupler is of the formula (IV)

(IV)

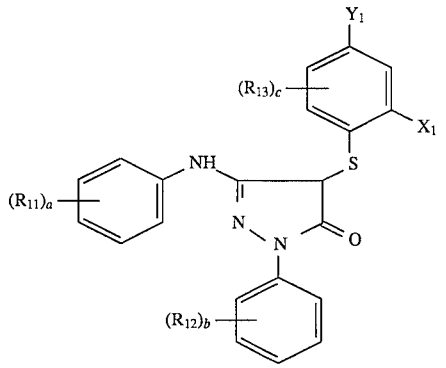

in which each of the $R_{11}$s can be identical or different and are hydrogen, alkyl, alkoxy, aryl, acyl, fluorine, chlorine, bromine, sulphonyl, silyl, nitro, alkoxycarbonyl, cyano, aroxycarbonyl, acylamino, sulphonamido or trifluoromethyl, each of the $R_{12}$s can be identical or different and are fluorine, chlorine, bromine, acyl, alkyl, alkoxy, alkoxycarbonyl, cyano, alkylsulphonyl, arylsulphonyl, alkoxysulphonyl, aroxysulphonyl, acylamino, sulphonamido, trifluoromethyl or nitro, $R_{13}$ means hydrogen, alkyl, aryl, acyl, fluorine, chlorine, bromine, sulphonyl, silyl, alkoxycarbonyl, cyano or aroxycarbonyl, $X_1$ means hydrogen, acylamino, sulphonamido, alkyl, alkoxy, alkoxycarbonyl, cyano, alkylsulphonyl, arylsulphonyl, alkoxysulphonyl or aroxysulphonyl, $Y_1$ means hydrogen, acylamino, sulphonamido, alkyl, alkoxy, alkoxycarbonyl, cyano, alkylsulphonyl, arylsulphonyl, alkoxysulphonyl or aroxysulphonyl, providing that either $X_1$ or $Y_1$ is hydrogen, a and b are identical or different and mean a number from 1 to 5 and c means a number from 0 to 4.

3. The color photographic silver halide material according to claim 2, wherein the magenta coupler is of the formula V (V)

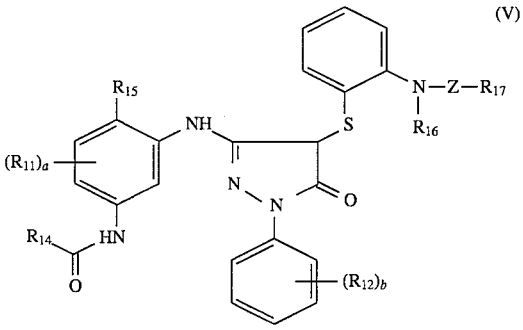

in which $R_{11}$ and $R_{12}$ are defined in claim 2, $R_{14}$ means alkyl, aryl, acyl, alkoxycarbonyl or aryloxycarbonyl, $R_{15}$ means fluorine, chlorine, bromine or alkoxy, $R_{16}$ means hydrogen, alkyl or aryl, $R_{17}$ means a alkyl or aryl, Z means —CO—, —SO— or —$SO_2$—, a means 0 or 1 and b means a number from 3 to 5.

4. The color photographic silver halide material according to claim 2, wherein $Y_1$ is hydrogen and $X_1$ acylamino or sulphonamido.

5. The color photographic silver halide material according to claim 4, wherein one of the residues $R_l$ is in the ortho position relative to the NH group and is alkoxy, fluorine, chlorine or bromine and b is a number from 3 to 5.

6. The color photographic silver halide material according to claim 1, wherein the compounds of the formulas (II) and (III) are used in a total quantity of 10 to 200 mol. % per mol of magenta coupler.

7. The color photographic silver halide material according to claim 1, wherein $L_1$ is $$-\overset{O}{\overset{\|}{C}}-R_5-\overset{O}{\overset{\|}{C}}O-R_6-$$

wherein $R_5$ and $R_6$ are identical are different and are alkylene, arylene or cycloalkylene and $L_1$ is attached via $R_6$ to the nitrogen atom of the piperidine ring.

8. The color photographic silver halide material according to claim 1, wherein m is a number from 3 to 15, and n is a number from 3 to 15.

9. The color photographic silver halide material according to claim 1, wherein the compounds of the formulas (II) and (III) are used in a total quantity of 20 to 60 mol. % per mol of magenta coupler.

* * * * *